US007150791B2

(12) United States Patent
Romine

(10) Patent No.: US 7,150,791 B2
(45) Date of Patent: Dec. 19, 2006

(54) FLOATING HEAD LIQUID DISPENSER WITH DISPENSING HEAD SENSOR

(75) Inventor: Michael J. Romine, Escondido, CA (US)

(73) Assignee: Nordson Corporation, Westlake, OH (US)

( * ) Notice: Subject to any disclaimer, the term of this patent is extended or adjusted under 35 U.S.C. 154(b) by 33 days.

(21) Appl. No.: 09/821,618

(22) Filed: Mar. 29, 2001

(65) Prior Publication Data

US 2002/0142102 A1 Oct. 3, 2002

(51) Int. Cl.
*B05C 11/10* (2006.01)

(52) U.S. Cl. ..... 118/669; 118/708; 118/712; 222/49; 222/47

(58) Field of Classification Search ..... 118/713, 118/714, 712, 669, 708; 739/73; 222/41, 222/45, 46, 47, 49, 50
See application file for complete search history.

(56) References Cited

U.S. PATENT DOCUMENTS 5,795,390 A * 8/1998 Cavallaro ..... 118/314
5,820,623 A * 10/1998 Ng ..... 606/1
6,132,809 A * 10/2000 Hynes et al. ..... 427/421
6,266,869 B1 * 7/2001 Tracy et al. ..... 29/740
6,391,387 B1 * 5/2002 Rutledge et al. ..... 427/256

OTHER PUBLICATIONS

Installation, Operation and Maintenance Manual MERS50 Linear Encoder System, Aug. 31, 1999, Linear Motor Systems, Anorad Linear Motor Division, Document No. 91181, All Pages.*

* cited by examiner

*Primary Examiner*—George Koch
(74) *Attorney, Agent, or Firm*—Wood, Herron & Evans,LLP

(57) ABSTRACT

A floating head liquid dispenser includes a robotic control mechanism for moving a support member toward and away from a substrate. A liquid dispensing head is operatively connected to the support member for movement relative thereto upon contact with the substrate. A linear displacement sensor is operatively connected to the support member and the liquid dispensing head so that displacement of the liquid dispensing head relative to the support member is sensed upon contact of the dispensing head with the substrate. The floating head liquid dispenser stops movement of the support member and dispensing head toward the substrate when the displacement is sensed to ensure proper positioning of the dispensing head relative to the substrate during a liquid dispensing cycle.

10 Claims, 1 Drawing Sheet

FLOATING HEAD LIQUID DISPENSER WITH DISPENSING HEAD SENSOR

FIELD OF THE INVENTION

The present invention relates generally to apparatus for dispensing liquid or viscous materials and, more particularly, to a floating head liquid dispenser for use in high speed, high precision deposition of liquid, such as solder paste, onto a substrate, with a high degree of repeatability.

BACKGROUND OF THE INVENTION

Liquid dispensing systems have become an integral part of the electronics manufacturing process for depositing underfill, encapsulants, solder fluxes, surface mount adhesives, conformal coatings and other materials onto a substrate, such as a printed circuit board. Each liquid dispensing system used in the electronics manufacturing process has a particular dispensing characteristic that is determined in large measure by the desired liquid dispense pattern on the substrate, the liquid flow rate and/or liquid viscosity of the dispensed material, and the desired electronic component assembly throughput through the dispensing system.

In the high speed dispensing, or pumping, of precise amounts of liquid for deposition onto a substrate, such as solder paste, it is common to use an auger, or screw, dispenser. Use of an auger dispenser helps achieve a high degree of repeatability and control of the liquid being dispensed. These features are important because of the high speed nature of this deposition process. For instance, in depositing "droplets" of solder paste onto a substrate, it is necessary in some applications to dispense the liquid at a rate of 25,000 dots per hour, or just less than 7 dots per second. Under these conditions, a high degree of liquid control is necessary in order to achieve sufficient repeatability and accuracy in the deposition process.

In an auger dispenser, an auger is held within a dispensing head. The auger extends along an axial flowpath for the liquid to be dispensed, with an outlet end of the auger located adjacent an exit port of the flowpath, and an opposite, drive end of the auger held by and rotatably driven by a coupling, which operatively connects to a drive motor via a drive shaft. The exit port of the flowpath is located at the terminal end of a dispensing tip that extends from the auger dispenser toward the substrate. The dispensing head has an inlet in fluid communication with the flowpath, and a liquid supply line supplies dispensing liquid to the flowpath through the inlet. Initially, liquid is supplied to the flowpath under pressure, to fill the flowpath along the length of the auger, and then the pressure is reduced to a lower operating level. Thereafter, incremental rotations of the drive motor cause rotation of the auger, thereby producing "droplets" of liquid, such as solder paste, to flow from the dispensing tip for deposition onto a substrate which is usually clamped in a fixed position.

In some instances, angular rotation of the motor drive shaft of about 1/16 of a full rotation results in a "droplet" of liquid exiting from the dispensing tip. Typically the dispenser is moved relative to the substrate, and discrete successive partial rotations of the motor shaft, and the auger coupled thereto, results in repeated deposition of liquid onto the substrate.

In "floating head" deposition of liquid onto a substrate, the dispensing head is operatively connected to a robotic control mechanism that moves the dispensing head in a vertical direction toward the substrate until a standoff, carried by the dispensing head, contacts the substrate. The dispensing head is mounted to "float" on the robotic control mechanism so that some amount of "play" is built into the system to accommodate the repeated impact of the dispensing head with the substrate. The standoff extends toward the substrate and has a length slightly greater than the length of the dispensing tip. In this way, very accurate and repeatable spacing of the dispensing tip away from the substrate is achieved when the standoff is positioned to contact the substrate. Liquid dispensing occurs when the standoff contacts the substrate, which occurs repeatedly during the liquid deposition process. The dispensing head moves toward the substrate until the standoff contacts the substrate, a liquid "droplet" is deposited on the substrate, and then the dispensing head moves away from the substrate. The dispensing head is then repositioned relative to the substrate and the liquid deposition cycle repeats again.

Prior to a dispensing cycle, the robotic control mechanism must be programmed to accurately move the dispensing head from a position spaced from the substrate to a position at which the standoff contacts the substrate to properly space the dispensing tip away from the substrate for a liquid dispensing cycle. The position of the dispensing head must be adjusted in the set-up procedure to ensure that the standoff contacts, but does not place significant force upon, the substrate during each dispensing cycle.

In the past, the initial set-up of the dispensing head position has been performed manually by an operator who adjusts and sets the dispense position of the dispensing head relative to the substrate by eye. For example, the operator moves the dispensing head toward the substrate until the standoff contacts the substrate. The robot control mechanism is instructed to "learn" the stroke or travel distance the dispensing head has moved to reach this position, and this value is then stored in memory as a "nominal" stroke or travel distance. For each dispensing cycle to follow, the dispensing head is programmed to move slightly beyond the stored "nominal" stroke or travel distance toward the substrate to ensure that the standoff contacts the substrate even when the substrate is warped or bowed in a direction beyond the "nominal" stroke.

Alternatively, the dispensing head may include a mechanical or optical probe mechanism, in addition to the standoff, that is capable of sensing contact of the dispensing head with the substrate. During initial set-up using the probe mechanism, the dispensing head is moved toward the substrate until the probe mechanism senses contact with the substrate. When this contact is sensed, the robot control mechanism is instructed to store the stroke or travel distance the dispensing head has moved as a "nominal" stroke or travel distance. The dispensing head is programmed to move slightly beyond the stored "nominal" stroke or travel distance toward the substrate to ensure proper positioning of the dispensing head for most conditions of the substrate as described above.

Regardless of which initial set-up procedure is used, it is possible that the programmed dispense position of the dispensing head may change over time due to variations in the positioning accuracy of the robotic control mechanism. These changes can lead to undertravel of the dispensing head toward the substrate wherein the dispensing tip is positioned too far away from the substrate so that the standoff does not contact the substrate. With undertravel, the desired formation of "droplets" onto the substrate is not achieved and the part must be reworked or scrapped. Alternatively, these changes can lead to overtravel of the dispensing head toward the substrate to a position beyond the built-in "play" or "floating" capability of the floating head liquid dispenser. With overtravel, the dispensing head may be moved toward the substrate so far that the dispensing tip actually pushes through the substrate, thereby ruining the part and even possibly damaging the floating head liquid dispenser as well. Undertravel and overtravel conditions can also occur when the substrate is severely warped so that proper contact of the standoff with the substrate is not achieved when the dispensing head is moved through the programmed stroke. In the past, these undertravel and overtravel failure modes of operation have been detectable only when an operator is present to see these failure conditions occur. As a result, significant part waste, and even equipment damage, can occur when the dispensing process is left unattended.

Thus, there is a need for a floating head liquid dispenser that provides simplified, yet accurate, reliable and repeatable position set-up of the dispensing head for a dispensing cycle.

There is also a need for a floating head liquid dispenser that reduces the potential for part waste and equipment damage during unattended dispensing of liquid onto a substrate in a "floating head" dispensing environment.

SUMMARY OF THE INVENTION

The present invention overcomes the foregoing and other shortcomings and drawbacks of floating head liquid dispensing systems and methods heretofore known for dispensing precise, discrete amounts of liquid onto a substrate. While the invention will be described in connection with certain embodiments, it will be understood that the invention is not limited to these embodiments. On the contrary, the invention includes all alternatives, modifications and equivalents as may be included within the spirit and scope of the present invention.

In accordance with the principles of the present invention, a floating head liquid dispenser includes a mount or support member that is operatively connected to a robotic control mechanism. The robot control mechanism is operable to move the support member toward and away from a substrate during a liquid dispensing cycle. A liquid dispensing head is operatively connected to the support member, and is capable of movement relative to the support member upon contact with the substrate. The liquid dispensing head includes a liquid flowpath extending therethrough that terminates in an outlet for dispensing fluid onto the substrate. A linear displacement sensor is operatively connected to the support member and the liquid dispensing head, and is coupled to the robotic control mechanism. The linear displacement sensor is capable of applying a signal to the robotic control mechanism that indicates a sensed displacement of the liquid dispensing head relative to the support member when the dispensing head contacts the substrate. In one embodiment, the linear displacement sensor includes an optical read head mounted on the support member and a graduated linear scale mounted on the liquid dispensing head that is capable of being read by the optical read head.

In accordance with one aspect of the present invention, the robotic control mechanism is responsive to the signal applied from the linear displacement sensor to stop movement of the support member toward the substrate when displacement of the liquid dispensing head relative to the support member is sensed, thereby indicating that the dispensing head is in contact with the substrate. At this position, the operator is assured that the standoff of the dispensing head is properly positioned in contact with the substrate without applying too much force that might otherwise damage the substrate.

Alternatively, the robotic control mechanism is operable to move the liquid dispensing head through a set range of acceptable dispensing positions during a dispense cycle. For example, the operator may set a minimum and maximum dispensing stroke of the dispensing head along an axis perpendicular to the substrate. The liquid dispensing head is moved toward the substrate until displacement of the dispensing head relative to the support member is sensed, thereby indicating contact of the dispensing head with the substrate. The robotic control mechanism is responsive to the signal applied from the linear displacement sensor to stop movement of the liquid dispensing head toward the substrate if the sensed displacement occurs outside of the set range of acceptable dispensing positions. Alternatively, the robotic control mechanism is operable to permit continued movement of the dispensing head toward the substrate, but provide an alert if the sensed displacement occurs outside of the set range of acceptable dispensing positions.

In accordance with another aspect of the present invention, the robot control mechanism is operable to move the support member and dispensing head through the set range of acceptable dispensing positions.

In the event the robot control mechanism does not receive a signal from the linear displacement sensor within the set range of acceptable dispensing movement of positions, movement of the support member toward the substrate is stopped. Alternatively, the robot control mechanism may permit continued movement of the dispensing head toward the substrate, but provide an alert so that an operator is notified to check the set-up and operation of the floating head liquid dispenser.

Accordingly, the floating head liquid dispenser of the present invention includes the capability to monitor both undertravel and overtravel conditions of the dispensing head that may result in scrap product or, in extreme cases, damage to the floating head liquid dispenser. The linear displacement sensor simplifies the set-up and operation procedures of the liquid dispenser and ensures accurate, reliable and repeatable positioning of the dispensing head relative to the substrate during a dispensing cycle.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENT

Figure 1:
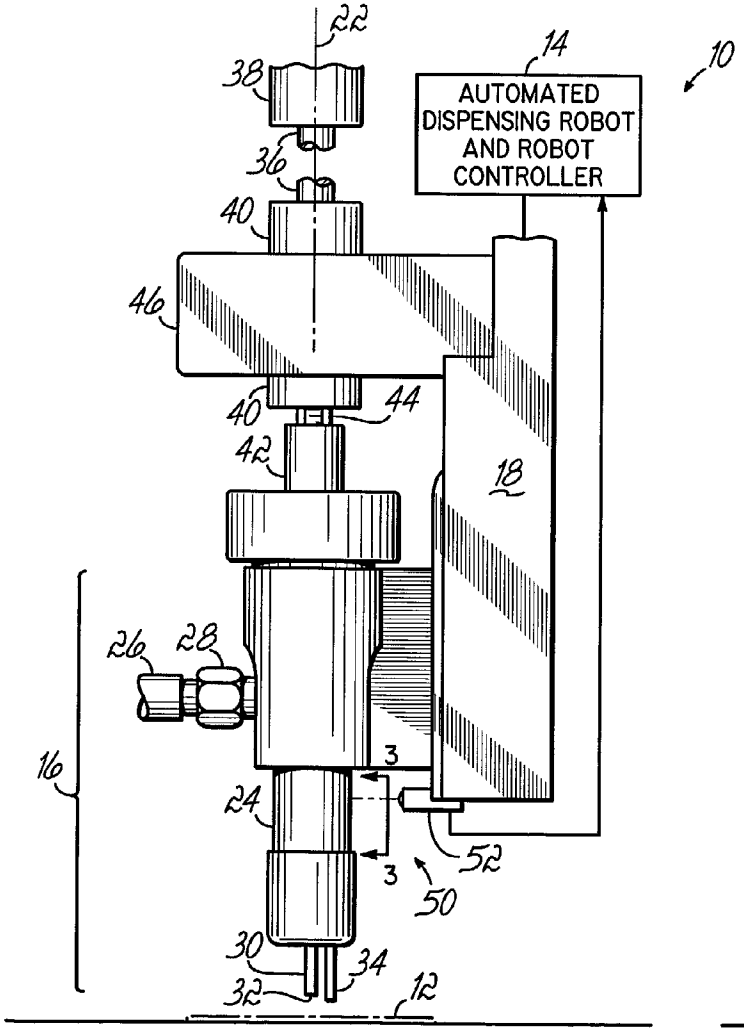
FIG. 1 is a side elevational view of a floating head liquid dispenser including a linear displacement sensor in accordance with the principles of the present invention, and showing the dispenser spaced from a substrate.

With reference to the Figures, a floating head liquid dispenser is shown in accordance with the present invention for depositing "droplets" of liquid material, such as solder paste, onto a substrate 12. As is well known in the art, floating head liquid dispenser 10 includes a robotic control mechanism 14 for moving a dispensing head 16 of the dispenser 10 toward and away from the substrate 12 that is clamped in a fixed position beneath the dispensing head 16.

Robot control mechanism 14 includes a mount or support member 18 that is moved toward and away from the substrate 12 under the control of the robot control mechanism 14. The dispensing head 16 is mounted to the support member 18 through a linear bearing (not shown) so that the dispensing head 16 moves with the support member 18, and is movable relative to the support member 18 upon contact with the substrate as indicated by arrow 20 in FIG. 2. The linear bearing (not shown) confines movement of the dispensing head 16 along a linear travel path of motion which is parallel to the dispensing axis 22. The dispensing head 16 is biased in a direction away from the support member 18 and toward substrate 12 through a spring (not shown) mounted within the support member 18. One embodiment of a floating head liquid dispenser 10 for use in the present invention is described in U.S. Ser. No. 09/436,297, entitled "Floating Head Liquid Dispenser With Quick Release Auger Cartridge" in the name of Michael J. Romine et al., the disclosure of which is hereby incorporated herein by reference in its entirety.

Figure 2:
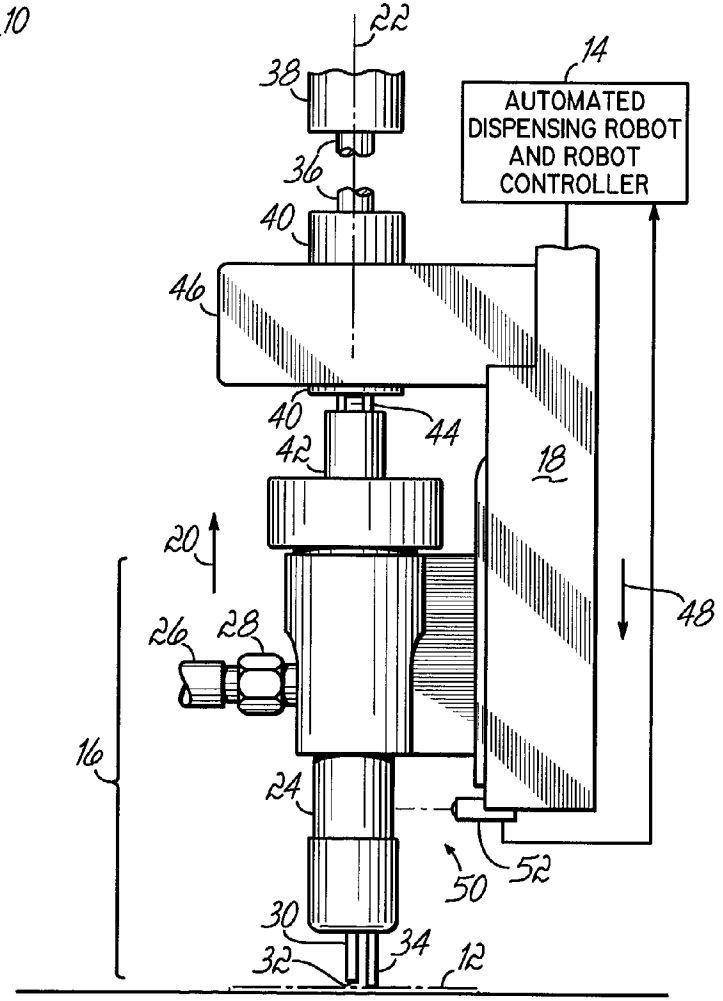
FIG. 2 is a view similar to FIG. 1 showing the dispenser in contact with the substrate to illustrate floating head operation of the dispenser.

Briefly, floating head liquid dispenser 10 includes an auger cartridge 24 that is removably connected to the dispensing head 16. The auger cartridge 24 receives liquid to be dispensed from a supply of liquid (not shown) that is connected to the auger cartridge 24 through a liquid supply tube 26 and a threaded fitting 28. An auger (not shown) is mounted within auger cartridge 24. A dispensing end of the auger cartridge 24 includes a dispensing tip 30 that extends toward the substrate 12 and terminates in a dispensing outlet 32. A standoff 34 also extends from the dispensing end of auger cartridge 24 and is adapted to contact the substrate 12 as shown in FIG. 2. In this contacting position with the substrate 12, the standoff 34 accurately positions or spaces the outlet 32 of dispensing tip 30 a predetermined distance way from the substrate 12 so that positioning errors of the robotic control mechanism 14 in a direction transverse to the substrate are eliminated during the dispensing cycle. It is to be understood, however, that other various types of dispensing heads 16 are suitable without departing from the spirit and scope of the present invention.

In a preferred embodiment, floating head liquid dispenser 10 includes a drive shaft 36 connected to a drive motor 38, with a ball coupling 40 connected to the drive shaft 36 and a drive coupling 42 connected through shaft 44 to the ball coupling 40. The auger cartridge 24 includes a drive end operatively coupled to the drive coupling 42 for driving the auger. The ball coupling 40 is preferably a "floating coupling" that has variable axial dimension to move axially and absorb impact when the standoff 34 repeatedly contacts the substrate 12 during liquid dispensing. Preferably, a support 46 extends laterally from support member 18 and surrounds the middle portion of the ball coupling 40. The auger (not shown) resides along and rotates about the dispensing axis 22, which is the same axis as the drive shaft 36 of the drive motor 38, and has an outlet end (not shown) that is located adjacent the outlet 32 of dispensing tip 30. As described below, incremental rotations of the drive motor 38 cause rotation of the auger, thereby producing "droplets" of liquid, such as solder paste, to flow from the dispensing tip 30 for deposition onto the substrate 12.

During a liquid dispense cycle, the robotic control mechanism 14 must be programmed to accurately move the dispensing head 16 from a position spaced from the substrate 12 as shown in FIG. 1 to a position at which the standoff 34 contacts the substrate 12 as shown in FIG. 2. In the position shown in FIG. 2, the robotic control mechanism 14 moves the support member 18 toward the substrate 12, as indicated by arrow 48, to contact the standoff 34 of dispensing head 16 with the substrate 12. Contact of the standoff 34 with substrate 12 causes the dispensing head 16 to move relative to the support member 18, i.e., the dispensing head 16 remains in a fixed position in contact with substrate 12 while the support member 18 continues to move toward the substrate 12. Axial play, or give, needed to accommodate "floating" of dispensing head 16 and impact with substrate 12 is provided by the ball coupling 40 and also by the linear bearing (not shown), as fully described in U.S. Ser. No. 09/436,297 previously incorporated herein by reference to which the reader is referred.

To ensure proper spacing of dispensing outlet 32 from substrate 12, the robotic control mechanism 14 must be properly programmed to move the dispensing head 16 toward the substrate until the standoff 34 contacts the substrate 12. Otherwise, undertravel of the dispensing head 16 toward the substrate 12 results in the dispensing tip 30 being positioned too far away from the substrate 12 so that the desired formation of "droplets" on the substrate 12 is not achieved and the part must be reworked or scrapped. The robotic control mechanism 14 must also be properly programmed to move the dispensing head 16 toward the substrate 12 a sufficient distance to contact the standoff 34 with the substrate 12, but not overtravel to a position beyond the built-in "play" or "floating" capability of the dispensing head 16. In an overtravel failure, the dispensing head 16 may be moved toward the substrate 12 so far that the dispensing tip 30 actually pushes through the substrate 12, thereby ruining the part and even possibly damaging the floating head liquid dispenser 10 as well.

Figure 3:
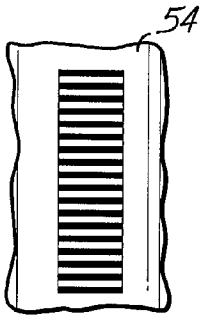
FIG. 3 is a view taken along line 3—3 of FIG. 1 showing a graduated linear scale of the linear displacement sensor of FIG. 1 affixed to the dispenser head of the floating head liquid dispenser.

In accordance with the principles of the present invention, the floating head liquid dispenser 10 includes a linear displacement sensor, indicated generally at 50, that is operable to generate a signal indicating displacement of the liquid dispensing head 16 relative to the support member 18 upon contact of the standoff 34 with the substrate 12. In a preferred embodiment of the present invention, the linear displacement sensor 50 comprises a linear encoder having an optical read head 52 mounted to the support member 18 and a graduated linear scale 54 (FIG. 3) mounted to the dispensing head 16 that is capable of being read by the optical read head 52. The optical read head 52 is coupled to the robotic control mechanism 14 and is operable to apply a signal to the robotic control mechanism 14 that indicates displacement of the liquid dispensing head 16 relative to the support member 18 as will be appreciated by those of ordinary skill in the art.

Of course, it will be appreciated that the orientation of the optical read head 52 and the graduated scale 54 can be reversed, and many other types of contact and non-contact linear displacement sensors are possible without departing from the spirit and scope of the present invention. For example, linear displacement sensor 50 may comprise a linear variable differential transducer (LVDT) or a linear displacement sensor that is able to indicate a displacement through a change in resistance, capacitance, inductance, piezoresistance, magnetic induction, doppler effect or other type of signal that is preferably proportional to displacement.

The linear displacement sensor 50 of the present invention simplifies operation of the floating head liquid dispenser 10 and provides accurate positioning of the dispensing head 16 during a liquid dispensing cycle. For example, in accordance with one aspect of the present invention, the support member 18 and dispensing head 16 are moved toward the substrate 12 during a dispensing cycle. The robotic control mechanism 14 is operable to receive signals generated by the linear displacement sensor 50 that indicate a sensed displacement of the dispensing head 16 relative to the support member 18. The robotic control mechanism 14 permits continued movement of the support member 18 and dispensing head 16 toward the substrate 12 until a signal is received from the linear displacement sensor 50 that indicates displacement of the dispensing head 16 relative to the support member 18. This displacement occurs upon contact of the standoff 34 with the substrate 12. Upon receipt of the signal, the robotic control mechanism 14 stops movement of the support member 18 and dispensing head 16 toward the substrate 12 to prevent potential damage to the floating head liquid dispenser 10 and substrate 12. With the liquid dispensing head 16, and more particularly the standoff 34, now properly positioned in contact with the substrate 12, the auger cartridge is driven incrementally by motor 38 to dispense a "droplet" of liquid from the dispensing tip 30 onto the substrate 12. Thereafter, the dispensing head 16 is moved away from the substrate 12 and repositioned before the liquid deposition cycle begins again. In this way, liquid dispensing is correlated to contact between the standoff 34 and the substrate 12, as determined by the signal generated by the linear displacement sensor 50, which occurs repeatedly during the liquid deposition process.

Alternatively, the robotic control mechanism 14 may be programmed with a range of acceptable dispensing positions of the dispensing head 16 as determined by the stroke of the support member 18 and dispensing head 16. In particular, the floating head liquid dispenser includes a position encoder that monitors the stroke or travel distance of the support member 18 and dispensing head 16 along a "Z" axis perpendicular to the substrate 12. For example, the robot control mechanism 14 may be programmed with a range of acceptance dispensing positions of between about 0.50 inches for a minimum acceptable dispensing stroke and about 3.0 inches for a maximum acceptable dispensing stroke along the "Z" axis.

In accordance with one aspect of the present invention, the robot control mechanism 14 is operable to move the support member 18 and dispensing head 16 toward the substrate 12. If the linear displacement sensor 50 senses displacement of the dispensing head 16 relative to the support member 18 outside of the set range of acceptable dispensing positions, movement of the support member 18 is stopped. For example, if the linear displacement sensor 50 applies a signal to the robot control mechanism 14 before the dispensing head 16 has reached the set minimum acceptable dispensing stroke, the robot control mechanism 14 stops further movement of the dispensing head 16 toward the substrate 12 to prevent possible damage to the floating head liquid dispenser 10 and the substrate 12. This may occur, by way of example, when the substrate 12 has dislodged from its supporting clamp and is canted in relation to its dispensing head 16. Alternatively, the robot control mechanism 14 may permit continued movement of the dispensing head 16 toward the substrate 12 upon receipt of the signal generated by the linear displacement sensor 50, but provide an alert so that an operator is notified to check the set-up and operation of the dispenser 10.

In accordance with another aspect of the present invention, the robot control member 14 is operable to move the support member 18 and dispensing head 16 toward the substrate 12 and through the set range of acceptable dispensing positions. In the event that the robot control mechanism 14 does not receive a signal from the linear displacement encoder 50 within the set range of acceptable dispensing positions, movement of the support member 18 is stopped. This may occur, for example, when the substrate 12 is missing from its support fixture or is severely warped, and the dispensing head 16 has moved beyond the set maximum acceptable dispensing stroke. Alternatively, the robot control mechanism 14 may permit continued movement of the dispensing head 16 toward the substrate 12 without receiving the signal from the linear displacement sensor 50 within the set range, but provide an alert so that an operator is notified of the occurrence.

The floating head liquid dispenser 10 of the present invention therefore provides the capability to monitor both undertravel and overtravel conditions of the dispensing head 16 that may result in scrap product or, in extreme cases, damage to the floating head liquid dispenser 10. The linear displacement sensor 50 simplifies operation of the floating head liquid dispenser 10 and ensures accurate, reliable and repeatable positioning of the dispensing head 16 relative to the substrate 12 during a dispensing cycle, even when the dispenser 10 is unattended.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A floating head liquid dispenser for dispensing liquid onto a substrate, comprising:

a support member mounted for linear movement toward and away from the substrate along a first axis;

a floating liquid dispensing head operatively connected to said support member and configured for floating linear movement relative to said support member along a second axis parallel to the first axis in response to contact of said liquid dispensing head with the substrate, said liquid dispensing head having a liquid flowpath extending therethrough terminating in an outlet for dispensing fluid onto the substrate; and a linear displacement sensor having a first sensor component supported by and movable with said support member and a second sensor component supported by and movable with said liquid dispensing head, said linear displacement sensor being configured to generate a signal that indicates a sensed displacement of said liquid dispensing head relative to said support member in response to contact of said liquid dispensing head with the substrate.

2. The floating head liquid dispenser of claim 1 wherein said linear displacement sensor comprises a linear encoder.

3. The floating head liquid dispenser of claim 2 wherein said linear encoder comprises an optical read head mounted on one of said support member and said liquid dispensing head, and a graduated linear scale mounted on said other capable of being read by said optical read head.

4. The floating head liquid dispenser of claim 1 further comprising a robotic control mechanism operatively connected to said support member for moving said support member toward and away from the substrate along the first axis, said linear displacement sensor being coupled to said robotic control mechanism for applying the signal to said robotic control mechanism that indicates a sensed displacement of said liquid dispensing head relative to said support member.

5. The floating head liquid dispenser of claim 4 wherein said robotic control mechanism is responsive to the signal applied from said linear displacement sensor to stop movement of said support member toward the substrate.

6. The floating head liquid dispenser of claim 4 wherein said robot control mechanism is responsive to the signal applied from said linear displacement sensor to provide an alert.

7. A floating head liquid dispenser for dispensing liquid onto a substrate, comprising:

a robotic control mechanism;

a support member operatively connected to said robotic control mechanism for linear movement toward and away from the substrate along a first axis under control of said robotic control mechanism;

a floating liquid dispensing head operatively connected to said support member and configured for floating linear movement relative to said support member along a second axis parallel to the first axis in response to contact of said liquid dispensing head with the substrate, said liquid dispensing head having a liquid flowpath extending therethrough terminating in an outlet for dispensing fluid onto the substrate; and a linear encoder having a first sensor component supported by and movable with said support member and a second sensor component supported by and movable with said liquid dispensing head, and coupled to said robotic control mechanism, said linear encoder being configured to apply a signal to said robotic control mechanism that indicates a sensed displacement of said liquid dispensing head relative to said support member in response to contact of said liquid dispensing head with the substrate.

8. The floating head liquid dispenser of claim 7 wherein said linear encoder comprises an optical read head mounted on one of said support member and said liquid dispensing head, and a graduated linear scale mounted on said other capable of being read by said optical read head.

9. The floating head liquid dispenser of claim 7 wherein said robotic control mechanism is responsive to the signal applied from said linear encoder to stop movement of said support member toward the substrate.

10. The floating head liquid dispenser of claim 7 wherein said robot control mechanism is responsive to the signal applied from said linear encoder to provide an alert.

* * * * *